United States Patent [19]

French

[11] 4,151,877

[45] May 1, 1979

[54] DETERMINING THE LOCUS OF A PROCESSING ZONE IN A RETORT THROUGH CHANNELS

[75] Inventor: Gordon B. French, Bakersfield, Calif.

[73] Assignee: Occidental Oil Shale, Inc., Grand Junction, Colo.

[21] Appl. No.: 796,700

[22] Filed: May 13, 1977

[51] Int. Cl.[2] ..... E21B 43/24; E21B 47/00

[52] U.S. Cl. ..... 166/251; 166/259; 299/2

[58] Field of Search ..... 166/251, 250, 252, 264, 166/259, 247; 299/2

[56] References Cited

U.S. PATENT DOCUMENTS

| | | | |
|---|---|---|---|
| 1,913,395 | 6/1933 | Karrick | 299/2 |
| 3,032,102 | 5/1962 | Parker | 166/251 |
| 3,454,365 | 7/1969 | Lumpkin et al. | 166/251 UX |
| 3,454,958 | 7/1969 | Parker | 166/256 |
| 3,490,529 | 1/1970 | Parker | 166/247 X |
| 3,513,913 | 5/1970 | Bruist | 166/247 X |
| 3,578,080 | 5/1971 | Closmann | 166/259 X |
| 3,630,278 | 12/1971 | Parker | 166/247 X |
| 3,698,478 | 12/1969 | Parker | 166/247 X |
| 3,892,270 | 7/1975 | Lindquidst | 166/251 |
| 3,950,029 | 4/1976 | Timmins | 166/256 X |

OTHER PUBLICATIONS

Carpenter, H. C., et al, "Retorting Ungraded Oil Shale as Related to in situ Combustion," *ACS Preprint*, vol. 15, 1971, Laramie Petroleum Research Center, Laramie, Wyoming, 14 pages.

Rothman, A. J., "Lawrence Livermore Laboratory Quarterly Report", Jul. 30, 1976.

*Primary Examiner*—Stephen J. Novosad

*Attorney, Agent, or Firm*—Christie, Parker & Hale

[57] ABSTRACT

The locus of a processing zone advancing through a fragmented permeable mass of particles in an in situ oil shale retort in a subterranean formation containing oil shale is determined by withdrawing a sample of gas passing through the retort through a channel through unfragmented formation and in fluid communication with the retort, and analyzing the composition of withdrawn gas. The channel can be artificially formed such as by hydraulic fracturing of unfragmented formation, or can be a naturally occurring permeable layer such as a tuff bed in the formation containing oil shale.

42 Claims, 1 Drawing Figure

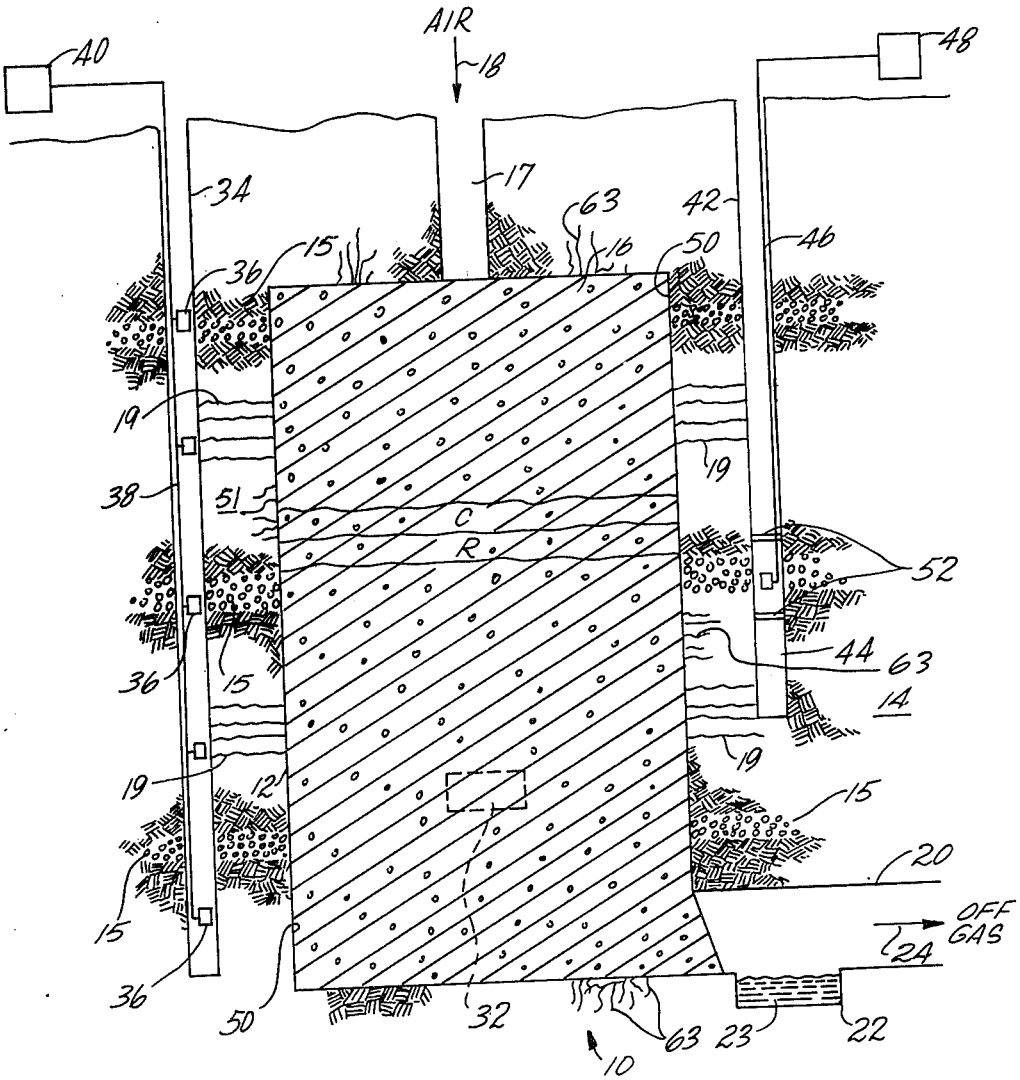
AIR
18
40
48
34
17
63
42
46
15
16
50
36
19
38
51
C
R
52
44
63
14
12
20
OFF GAS
24
32
23
22
10

DETERMINING THE LOCUS OF A PROCESSING ZONE IN A RETORT THROUGH CHANNELS

BACKGROUND OF THE INVENTION

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising marlstone deposit with layers containing an organic polymer called "kerogen," which upon heating decomposes to produce carbonaceous liquid and gaseous products. It is the formation containing kerogen that is called "oil shale" herein, and the liquid carbonaceous product is called "shale oil." The formation containing oil shale can contain a layer or intermittent layers which are permeable to gases. Exemplary of such a permeable layer is a tuff bed which is composed of compacted volcanic fragments, generally smaller than 4 millimeters in diameter. In the western United States such tuff beds and formation layers containing kerogen are near horizontal.

Formation containing oil shale in the Piceance Creek basin in Colorado has three well defined tuff beds which are persistent throughout the basin. These tuff beds are known as the "curly" tuff bed, the "wavy" tuff bed, and the "mahogany marker" tuff bed. The "curly" bed is about 2 feet thick and is above a mahogany zone, a well defined stratum in the Piceance Creek basin which has a relatively high kerogen content. The "mahogany marker", so named because it is in the middle of the mahogany zone, has a thickness of from about 6 to 8 inches. The "wavy" tuff bed, which is below the mahogany zone, has a thickness of about 2 feet. Other tuff beds of three to four inches in thickness are present throughout the Piceance Creek basin.

A number of methods have been proposed for processing oil shale which involve either first mining the kerogen bearing shale and processing the shale above ground, or processing the shale in situ. The latter approach is preferable from the standpoint of environmental impact since the spent shale remains in place, reducing the chance of surface contamination and the requirement for disposal of solid wastes.

The recovery of liquid and gaseous products from oil shale deposits has been described in several patents, one of which is U.S. Pat. No. 3,661,423, issued May 9, 1972, to Donald E. Garrett, assigned to the assignee of this application, and incorporated herein by this reference. This patent describes in situ recovery of liquid and gaseous hydrocarbon materials from a subterranean formation containing oil shale by mining out a portion of the subterranean formation and then explosively fragmenting and expanding remaining formation to form a stationary, fragmented, permeable mass of formation particles containing oil shale within the formation, referred to herein as an in situ oil shale retort. Hot retorting gases are passed through the fragmented mass in the in situ oil shale retort to convert kerogen contained in the oil shale to liquid and gaseous products.

One method of supplying hot gases used for converting kerogen contained in the oil shale, as described in U.S. Pat. No. 3,661,423, includes establishment of a combustion zone in the fragmented mass in the retort and introduction of a gaseous combustion zone feed comprising oxygen into the combustion zone to advance the combustion zone through the retort. In the combustion zone oxygen in the combustion zone feed is depleted by reaction with hot carbonaceous materials to produce heat and combustion gas. By the continued introduction of the combustion zone feed downwardly into the combustion zone, the combustion zone is advanced downwardly through the retort.

The effluent gas from the combustion zone comprises combustion gas and any gaseous portion of the combustion zone feed that does not take part in the combustion process. This effluent gas is essentially free of free oxygen and can contain constituents such as oxides of carbon, water vapor and sulfurous compounds. It passes through the fragmented mass on the advancing side of the combustion zone to heat the oil shale in a retorting zone to a temperature sufficient to produce kerogen decomposition, called retorting, in the oil shale to gaseous and liquid products and to a residue of solid carbonaceous material.

The liquid products and gaseous products are cooled by the cooler oil shale fragments in the retort on the advancing side of the retorting zone. The liquid hydrocarbon products, together with water produced in or added to the retort, are collected at the bottom of the retort and withdrawn to the surface through an access tunnel, drift or shaft. An off gas containing combustion gas generated in the combustion zone, product gas produced in the retorting zone, gas from carbonate decomposition, and any gaseous portion of the combustion zone feed that does not take part in the combustion process is also withdrawn from the bottom of the retort to the surface. The off gas can contain constituents such as hydrogen, water vapor, hydrogen sulfide, oxides of carbon, methane, ethane, propane, and other hydrocarbons.

As used herein, the term "processing gas" is used to indicate gas which serves to advance a processing zone such as a combustion zone, a retorting zone, or both a retorting zone and combustion zone, through an in situ oil shale retort, and includes, but is not limited to, an oxygen containing gas introduced into a retort for advancing a combustion zone and retorting zone through a retort and a hot retorting gas which can be introduced into a retort or generated in a combustion zone in a retort for advancing a retorting zone through a retort.

It is desirable for many reasons to know the locus of the combustion and retorting processing zones as they advance through an in situ oil shale retort. One reason is that by knowing the locus of the combustion zone, steps can be taken to control the orientation of the advancing side of the combustion zone. It is desirable to maintain a combustion zone which is flat and uniformly transverse and preferably uniformly normal to the direction of its advancement. If the combustion zone is skewed relative to its direction of advancement, there is more tendency for oxygen present in the combustion zone to oxidize hydrocarbon products produced in the retorting zone and reducing hydrocarbon yield. In addition, with a skewed combustion zone, more cracking of the hydrocarbon products can result. Determining the locus of the combustion zone provides information for control of the advancement of the combustion zone to maintain it flat and uniformly perpendicular to the direction of its advancement to obtain high yield of hydrocarbon products.

Another reason for determining the locus of the combustion zone is so that the composition of the combustion zone feed can be varied with variations in the kerogen content of the oil shale being retorted. If combustion zone feed containing too high a concentration of oxygen is introduced into a region of the retort containing oil shale having a high kerogen content, oxidation of carbonaceous material in the oil shale can generate so much heat that fusion of the oil shale can result. High temperatures also can cause excessive endothermic carbonate decomposition to carbon dioxide and dilution of the off gas from the retort, thereby lowering the heating value of the off gas. Layers in the fragmented mass are correlated with strata in the unfragmented formation because there is little vertical mixing between strata when explosively fragmenting formation to form a fragmented permeable mass of formation particles. Therefore, samples of various strata through the retort can be taken before initiating retorting of the oil shale and assays can be conducted to determine the kerogen content. Then, by determining the locus of the combustion zone as it advances through the retort, the composition of the combustion zone feed can be appropriately modified.

Another reason for determining the locus of the combustion and retorting processing zones as they advance through the retort is to monitor the performance of the retort to determine if sufficient shale oil is being produced for the amount of oil shale being retorted.

Also, by determining the locus of the combustion and retorting zones, it is possible to control the advancement of these two zones through the retort at an optimum rate. The rate of advancement of the combustion and retorting zones through the retort can be controlled by varying the flow rate and composition of the combustion zone feed. Knowledge of the locus of the combustion and retorting zones allows optimization of the rate of advancement to produce hydrocarbon products of the lowest cost possible with cognizance of the overall yield, fixed costs, and variable costs of producing the hydrocarbon products.

Attempts to determine the locus of combustion and retorting processing zones in an in situ oil shale retort with temperature transducers or devices for withdrawing gas samples have encountered problems with corrosion. Not only are high temperatures present in a retort, but also the gases passing through the retort contain corrosive compounds such as water, hydrogen sulfide and other sulfurous compounds. Therefore, temperature transducers and sampling devices placed directly in a retort can fail from corrosion in a matter of weeks, or even days.

Thus, it is desirable to provide a method for determining the locus of combustion and retorting processing zones advancing through an in situ oil shale retort.

SUMMARY OF THE INVENTION

The present invention concerns a process for determining the locus of a processing zone advancing through a fragmented permeable mass of formation particles in an in situ oil shale retort in a subterranean formation containing oil shale. The method comprises the steps of withdrawing a sample of gas from the retort through at least one channel through unfragmented formation and in communication with the retort and analyzing the composition of withdrawn gas. The channel can be a naturally occurring channel or an artificially formed channel. The naturally occurring channel can be a naturally occurring permeable layer such as a tuff bed. An artificial channel can be formed by fracturing unfragmented formation adjacent the retort such as by hydraulic fracturing.

When it is desired to determine the locus of a combustion zone, the withdrawn gas can be analyzed by determining the concentration of oxygen in the gas, or it can be analyzed by determining the concentration in the withdrawn gas of a constituent generated in the combustion zone. When it is desired to determine the locus of a retorting zone advancing through a retort, the withdrawn gas can be analyzed by determining the concentration in the withdrawn gas of a constituent generated in the retorting zone.

DRAWINGS

These and other features, aspects, and advantages of the present invention will become more apparent upon consideration of the following description, appended claims and accompanying drawing which schematically represents in vertical cross section an in situ oil shale retort having means for determining the locus of a processing zone advancing through the retort.

DESCRIPTION

Referring to the drawing, an in situ oil shale retort 10 is in the form of a cavity 12 formed in an unfragmented subterranean formation 14 containing oil shale and permeable layers or strata such as tuff beds 15. The retort has walls or boundaries 50 of unfragmented formation 14 and contains a fragmented permeable mass 16 of formation particles containing oil shale. The cavity 12 can be created simultaneously with fragmentation of the mass of formation particles 16 by blasting by any of a variety of techniques. A desirable technique involves excavating a void within the in situ oil shale retort site and explosively fragmenting and expanding remaining oil shale in the site toward the void. A method of forming an in situ oil retort is described in U.S. Pat. No. 3,661,423. A variety of other techniques can also be used.

Such explosive expansion of formation can create a fractured zone 51 in unfragmented formation adjacent the retort, the fractured zone extending about 10 feet from the boundaries 50 of the retort. This fractured zone can be extensively fractured, containing a plurality of fractures 63 radiating from the walls 50 of the retort.

A conduit 17 communicates with the top of the fragmented mass of formation particles. During the retorting operation of the retort 10, a combustion processing zone C is established in the retort and advanced by introducing as a processing gas an oxygen containing retort inlet mixture, such as air 18 or air mixed with other gases, into the in situ oil shale retort through the conduit 17. As the retort inlet mixture, which provides a combustion zone feed, is introduced to the retort, oxygen oxidizes carbonaceous material in the oil shale to produce combustion gas. Heat from the exothermic oxidation reactions carried by flowing gases advances the combustion zone through the fragmented mass of particles.

Combustion gas produced in the combustion zone and any gaseous unreacted portion of the combustion zone feed are passed through the fragmented mass of particles on the advancing side of the combustion zone to establish a retorting processing zone R on the advancing side of the combustion zone. Kerogen in oil shale is retorted in the retorting zone to liquid and gaseous products.

There is an access tunnel, adit, drift 20 or the like in communication with the bottom of the retort. The drift contains a sump 22 in which liquid products 23 are collected to be withdrawn for further processing. An off gas 24 containing gaseous products, combustion gas, gas from carbonate decomposition, and any gaseous unreacted portion of the combustion zone feed is also withdrawn from the in situ oil shale retort 10 by way of the drift 20.

The composition of the gas passing through a region of the retort 10 varies as the combustion and retorting processing zones approach and pass the region. For example, a representative region 32 represented in phantom in the drawing experiences five stages of changing gas composition during the retorting process.

Initially there is a stable period when the region 32 is traversed by off gas which contains constituents such as oxides of carbon, hydrogen, methane, ethane, nitrogen, propane, water vapor and hydrogen sulfide.

During a second period, as the retorting processing zone R approaches the region 32, and the temperature of the region 32 increases, the gases traversing the region contain increasing amounts of heavier hydrocarbons such as butane and pentane which subsequently condense on the cooler oil shale particles downstream of the region 32 for collection in the sump 22 as part of the liquid product.

This general trend developed during the second period reaches its culmination in the third period when the retorting zone R reaches the region 32. As the retorting zone R advances through the region 32, the concentration of constituents generated in the retorting zone decreases in the gas passing through the region 32. Gaseous constituents generated in the retorting zone include hydrocarbons such as methane, ethane, and propane, and sulfurous compounds such as hydrogen sulfide. In addition, it is believed that some water vapor is released from formation particles during the retorting process and alkaline earth metal carbonates present in the oil shale can decompose to produce carbon dioxide. Therefore, as the retorting zone R passes through the region 32, the concentration of carbon dioxide, water vapor, hydrogen sulfide, hydrogen, and hydrocarbons in the gases passing through the region 32 decreases.

During the fourth period the combustion zone C advances through the region 32. As this occurs, the concentration of constituents consumed in the combustion zone increases in the gas traversing the region 32 and the concentration of constituents generated in the combustion zone decreases. Thus the region 32 is exposed to a gas containing an increasing concentration of oxygen. Constituents generated in the combustion zone can include carbon monoxide, water vapor, and carbon dioxide, both by oxidation of carbonaceous material in the oil shale and carbonate decomposition. Thus the region 32 is exposed to a gas containing a decreasing concentration of these constituents as the combustion zone passes through it.

During the fifth period, when the region 32 is on the trailing side of the combustion zone C, the region is traversed by gas having substantially the composition of the retort inlet mixture 18. Thus the composition of the gas passing through the region 32 ordinarily changes only with changes in the composition of the retort inlet mixture after the combustion zone has passed.

According to the method of this invention, the locus of a processing zone advancing through the fragmented mass of particles in an in situ oil shale retort is determined by withdrawing a sample of gas from the retort through a channel such as a naturally occurring permeable layer in fluid communication with the permeable mass, and analyzing the composition of withdrawn gas from changes in its composition.

For example, referring to the drawing, in a version of this invention there are a plurality of generally horizontal permeable tuff beds 15 through the formation 14 in which the retort 10 is formed. In the Piceance Creek basin in Colorado, the tuff beds can be the "curly" tuff bed, the "wavy" tuff bed and the "mahogany marker" tuff bed, which are described above. The oil shale in the formation is almost impermeable to gas flow while the tuff beds are naturally permeable to gas flow. This is because the oil shale is a compacted, fine grained sedimentary formation while the tuff beds are relatively uncompacted volcanic ash. The permeability of the tuff beds can be several orders of magnitude larger than the permeability of oil shale. The tuff beds are substantially normal to the direction of advancement of the combustion zone and the retorting zone through the fragmented permeable mass of particles in the retort.

The tuff beds or layers 15 are in fluid communication with the fragmented permeable mass of particles 16 in the retort. The elevation of the tuff beds 15 can be determined when mining out a portion of the subterranean formation 14 for forming the retort 10 or by taking core samples of the formation.

During the retorting operation, gases present in the retort can pass into these tuff beds 15. Changes in the composition of the gases present in the tuff beds reflect changes in the composition of gases passing through the region of the retort adjacent the tuff bed.

To sample the gases passing through the retort for analysis, a well 34 such as a cased or uncased bore hole is formed, such as by drilling, in unfragmented formation outside the boundaries of the fragmented mass of formation in the in situ oil shale retort. The well extends through unfragmented formation 14 adjacent the fragmented permeable mass 16 in the retort and is in open fluid communication with at least one tuff bed 15 which is in fluid communication with the retort. The well is not shown to scale in the drawing, being much smaller in relation to the retort than indicated in the drawing. Within the well are a plurality of gas sampling means 36 such as a sample tube having an opening. Each of the gas samplers 36 is connected to gas transfer means such as multi-conduit tubing string 38 connected to analysis means 40 above ground. When a casing is used, the casing is perforated adjacent the samplers. Straddle packers 52 such as used in oil wells can be used between adjacent gas samplers 36 to isolate them from nearby channels. The locus of the combustion or retorting processing zone is determined by analyzing gas from each sampler 36 for its composition.

The pressure in the retort can be above, at, or below ambient pressure. If the retort is below ambient pressure, it is necessary to suck a sample of gas through a tuff bed and into the well. Thus, the gas samplers can be devices such as suction nozzles assisted by suction means (not shown).

The above ground analysis means 40 can be devices utilizing any of several analytical methods such as mass spectrometry, gas chromotography, infrared spectroscopy or wet chemical techniques.

A sample of gas can be withdrawn from the retort through not only a naturally occurring channel in unfragmented formation adjacent the retort, but also through an artificially created channel. For example, gas can be withdrawn from a retort through one or more fractures 63 created by the detonation of explosive to form the fragmented permeable mass in the retort.

In addition, fractures 19 can be formed in unfragmented formation between a well in formation adjacent the retort and the fragmented permeable mass in the retort by many techniques. Such techniques are described in U.S. Pat. application Ser. No. 567,509 filed Apr. 14, 1975, now U.S. Pat. No. 4,045,085 assigned to the assignee of this invention, and incorporated herein by reference. This patent application describes techniques which can be used for fracturing unfragmented formation between a bore hole and an in situ oil shale rerort. Techniques which can be used include electrolinking, hydraulic fracturing, hydraulic fracturing with propping, and explosive fracturing. Each of these techniques is described in detail in U.S. Pat. No. 4,045,085. Unfragmented formation can be fractured by any one or combination of these techniques. Fracturing can be effected by lowering a fracturing device, such as electrodes in the case of electro-linking, into a bore hole or well provided in unfragmented formation adjacent the retort.

Fractures formed in unfragmented formation tend to follow planes of weakness such as cleavage planes, joints, or slip planes; however, the fractures may lie in substantially any orientation. Generally in oil shale the fractures follow planes of weakness and extend in substantially horizontal and vertical planes in the formation. Using these techniques, the location and orientation of artificially induced fractures in formation adjacent a retort can be at least partially controlled.

To orient artificially induced fractures so that they extend horizontally in the subterranean formation containing oil shale, the formation can be notched or directionally cut out to direct induced fractures to propagate horizontally. It is desirable to have the fractures propagate horizontally so that the location in the retort from which a gas sample is withdrawn is known.

A microlog can be used to detect small fractures in the formation which are suitable for expansion into channels usable for withdrawing gas from the oil shale retort.

Preferably gas samples are withdrawn from the retort at at least two locations spaced apart from each other in a plane substantially normal to the direction of advancement of a processing zone being monitored. That is, in the case of a processing zone advancing downwardly through a retort, preferably gas is withdrawn from the retort at at least two selected locations spaced apart from each other at a selected elevation in the retort. For example, a second well 42 containing sampling means 44 and gas transfer means 46 is provided. The gas transfer means 46 is in communication with an analysis means 48 above ground. When the channels are horizontal, the sampler 44 in the second well 42 is at the same elevation as a gas sampler 36 in the first well 34. The gas sampler 44 is laterally spaced apart from the gas sampler 36 at the same elevation. This arrangement permits determination of whether a processing zone advancing through the fragmented permeable mass is flat and uniformly perpendicular to its direction of advancement. When two gas samplers at substantially the same elevation and laterally spaced apart from each other withdraw gas of different composition, this indicates that the processing zone is not flat and/or skewed relative to its direction of advancement. When two samplers at substantially the same elevation withdraw gas of substantially the same composition, this indicates that the processing zone is flat and substantially perpendicular to its direction of advancement.

More preferably gas samples are withdrawn from the retort at at least three locations spaced apart from each other in a plane substantially normal to the direction of advancement of a processing zone because according to geometrical principles, three points are required to define a plane. Use of only two gas samplers may not provide sufficient information that a processing zone is skewed.

To withdraw gas from the retort from at least two, and more preferably at least three, locations spaced apart from each other in a plane substantially normal to the direction of advancement of a processing zone, preferably at least two, and more preferably at least three wells are provided in unfragmented formation around the outside perimeter of the retort.

As shown by well 34 in the drawing, gas samples can be withdrawn from the retort at a plurality of locations spaced apart from each other along the direction of advancement of a processing zone through the fragmented mass to permit tracking of the processing zone as it advances during the retorting process. When a processing zone is advancing downwardly or upwardly through the fragmented mass, gas can be withdrawn from the retort at locations vertically spaced apart from each other.

Also as shown in the drawing, gas samples can be withdrawn from the retort at locations spaced apart from each other along the direction of advancement of a processing zone and at locations in a plane normal to the direction of advancement of a processing zone in combination for determining if a processing zone is skewed and/or warped throughout the retorting process.

Instead of providing many gas sampling means in a well, one or more sampling means 36 and their packers can be repositioned within the well as retorting progresses.

Preferably gas samples are withdrawn from the retort via naturally occurring and/or artificially formed channels vertically spaced apart from each other, where the distance between adjacent channels is about equal to the minimum thickness of the processing zone being monitored. This is to allow accurate determination of the locus of the processing zone as it advances through a retort. However, when advancing a combustion zone through oil shale having a high kerogen content, the combustion zone can be as narrow as 1 to 2 feet. In such a situation, providing fractures and gas sampling means spaced apart at a distance from 1 to 2 feet for a retort which has a depth of hundreds of feet can be probibitively expensive. If desired, useful data can be obtained by withdrawing gas samples from the retort at locations spaced apart from each other up to about 5 times the minimum thickness of an established combustion zone.

Preferably the sampling wells 34, 46 are formed after blasting to form the cavity 12 and the fragmented mass 16 to minimize the likelihood of closure of the wells during blasting. Preferably the sampling wells are provided beyond the fractured zone 51 of formation adjacent a retort prepared by explosive expansion of formation. That is, preferably the wells are provided at a distance greater than about 15 feet from the side boundaries of the retort. This avoids leakage of gas from the retort into the well through the fractures 63 in the fractured zone 51 from locations within the retort whose elevation and position are unknown. To insure that gas samples of sufficient volume can be withdrawn from the retort and to minimize the amount of formation which needs to be fractured when using artificially created channels for withdrawing gas from the retort, preferably the sample wells are provided at a distance less than about 20 feet from the side boundaries 50 of the retort.

Using a method such as the method of this invention to determine the locus of the combustion zone C advancing through the fragmented permeable mass 16 in the retort 10 has significant advantages. For example, steps can be taken to maintain the combustion zone flat and minimize skewing of the combustion zone relative to its direction of its advancement to minimize oxidation and excessive cracking of hydrocarbons produced in the retorting zone. In addition, the rate of introduction and composition of oxygen supplying gas introduced into the combustion zone can be controlled to maintain the temperature in the combustion zone sufficiently low to avoid excessive amounts of carbonate decomposition and to prevent fusion of the oil shale. Furthermore, knowledge of the locus of the combustion and retorting zones as they advance through the retort allows monitoring the performance of a retort. Knowledge of the locus of the combustion and retorting zones also allows optimization of the rate of advancement of these processing zones to produce hydrocarbon products of the lowest possible cost by varying the composition of and introduction rate of the oxygen supplying gas.

A particular advantage of the method of this invention is that no monitoring equipment needs to be positioned in the retort 10. Thus, the monitoring equipment used is not exposed to the high temperature and corrosive environment present in the retort. This allows use of a low cost conduit or casing formed from low performance materials such as carbon steel for the wells 34, 42 and conduits 38 and 46. In addition, special sampling equipment and gas carrying means requiring resistance to high temperatures and/or corrosive environments are not required.

Although this invention has been described in considerable detail with reference to certain versions thereof, other versions are within the scope of this invention. For example, although the invention has been described in terms of a single in situ oil shale retort containing both a combustion processing zone and a retorting processing zone, it is possible to practice this invention with a retort containing only one processing zone, either a combustion or retorting zone. In addition, although the drawing shows a retort where the combustion and retorting zones are advancing downwardly through the retort, this invention is also useful for retorts where the combustion and retorting zones are advancing upwardly or transverse to the vertical.

Also, even though the drawings show a retort having a plurality of channels with at least one gas sampler for each channel, this invention can be practiced with a retort in communication with only one channel, or with a retort having a plurality of channels such as tuff beds where only one gas sampler is provided. In this latter version of the invention, the location of a processing zone advancing through the retort can be determined by moving a sampler and packers up and down through a well to withdraw gas at different elevations to define the locus of a processing zone.

Because of variations such as these, the spirit and scope of the appended claims should not be limited to the description of the preferred versions contained herein.

What is claimed is:

1. A method for recovering hydrocarbons from a subterranean formation containing oil shale comprising the steps of:

forming an in situ oil shale retort having boundaries of unfragmented formation and containing a fragmented permeable mass of formation particles containing oil shale in a subterranean formation containing oil shale, the subterranean formation having at least one substantially horizontal permeable layer in fluid communication with the permeable mass between the top and the bottom of the permeable mass;

drilling a hole through the subterranean formation outside the boundaries of the in situ oil shale retort in unfragmented formation for establishing fluid communication in unfragmented formation outside the boundaries of the in situ oil shale retort with such a permeable layer;

establishing a combustion zone in the fragmented permeable mass in the retort;

introducing a processing gas containing oxygen to the fragmented mass for advancing the combustion zone downwardly through the fragmented mass and for retorting oil shale in a retorting zone on the advancing side of the combustion zone to produce hydrocarbons;

withdrawing off gas comprising hydrocarbons from the bottom of the fragmented mass;

withdrawing a sample of gas from the retort through such a permeable layer into said hole with a gas sampling means in said hole; and analyzing the composition of the withdrawn gas sample to determine the locus of the combustion zone.

2. A method for determining the locus of a processing zone advancing through a fragmented permeable mass of particles in an in situ oil shale retort in a subterranean formation containing oil shale, the fragmented mass having gases passing therethrough between an inlet and an outlet and being in direct fluid communication at at least one location between the inlet and the outlet with at least one channel in unfragmented formation adjacent the retort, the method comprising the steps of:

withdrawing a sample of gas from the retort through such a channel in direct fluid communication with the fragmented permeable mass; and analyzing the composition of withdrawn gas to determine the locus of the processing zone.

3. A method as claimed in claim 2 in which the step of analyzing comprises withdrawn gas for the concentration of at least one constituent selected from the group consisting of oxygen, carbon monoxide, carbon dioxide, sulfur dioxide, hydrogen, water vapor, hydrogen sulfide, methane, ethane, and propane.

4. A method as claimed in claim 2 in which the processing zone is a combustion zone and the step of analyzing comprises determining the concentration of oxygen in withdrawn gas.

5. A method as claimed in claim 2 in which the processing zone is a combustion zone and the step of analyzing comprises determining the concentration in withdrawn gas of a constituent generated in the combustion zone.

6. A method as claimed in claim 2 in which the processing zone is a retorting zone and the step of analyzing comprises determining the concentration in withdrawn gas of a constituent generated in the retorting zone.

7. A method as claimed in claim 2 in which the step of withdrawing comprises withdrawing a sample of gas from the retort through such a channel which is substantially normal to the direction of advancement of the processing zone through the fragmented permeable mass of particles in the in situ oil shale retort.

8. A method as claimed in claim 2 including the step of forming such a channel in fluid communication with said retort through which a sample of gas is withdrawn.

9. A method as claimed in claim 2 in which the channel through which a sample of gas is withdrawn from the retort is a naturally occurring permeable layer.

10. A method as claimed in claim 9 in which the naturally occurring permeable layer through which a sample of gas is withdrawn from the retort is a tuff bed.

11. A method for sampling gas from an in situ oil shale retort in a subterranean formation containing oil shale comprising boundaries of unfragmented formation and containing a fragmented permeable mass of formation particles containing oil shale, the retort having a gas inlet and a gas outlet, said formation including at least one channel in unfragmented formation in direct fluid communication with the fragmented mass in the retort at at least one location between the gas inlet and the gas outlet, the method comprising the step of withdrawing a sample of gas from the retort through such a channel in fluid communication with the fragmented permeable mass.

12. A method as claimed in claim 11 in which the channel through which a sample of gas is withdrawn is a tuff bed.

13. A method as claimed in claim 11 in which there are at least two channels in direct fluid communication with the fragmented mass in the retort between the gas inlet and the gas outlet, and the method comprises the step of withdrawing gas from the retort simultaneously through at least two such channels in direct fluid communication with the fragmented permeable mass.

14. A method for determining the locus of at least one processing zone advancing through a fragmented permeable mass of particles in an in situ retort in a subterranean formation, the retort having a combustion processing zone advancing therethrough and a retorting processing zone advancing therethrough on the advancing side of the combustion zone, the retort being in direct fluid communication with at least one naturally occurring permeable layer in unfragmented formation adjacent fragmented mass, the retort having gases passing therethrough, the method comprising the steps of:

withdrawing at least one sample of gas from the retort through such a naturally occurring permeable layer in communication with said retort; and monitoring withdrawn gas for changes in its composition to determine the locus of a processing zone.

15. The method of claim 14 in which the naturally occurring permeable layer is a tuff bed.

16. A method for processing oil shale in a subterranean formation containing oil shale comprising the steps of:

forming an in situ oil shale retort having boundaries of unfragmented formation and containing a fragmented permeable mass of formation particles containing oil shale in a subterranean formation containing oil shale, the subterranean formation having at least one channel in direct fluid communication with the fragmented mass between the top and the bottom of the fragmented mass;

establishing fluid communication in unfragmented formation outside the boundaries of the in situ oil shale retort with such a channel;

introducing a processing gas to the top of the fragmented mass;

withdrawing off gas from the bottom of the fragmented mass; and withdrawing a sample of gas from the fragmented mass between the top and bottom of the fragmented mass through such a channel.

17. A method as claimed in claim 16 comprising the additional steps of establishing a processing zone in the retort, wherein the step of introducing a processing gas comprises introducing a processing gas to the top of the fragmented mass to advance the processing zone downwardly through the fragmented mass, and comprising the additional step of analyzing the composition of the withdrawn gas sample to determine the locus of the processing zone.

18. A method as claimed in claim 17 in which the step of establishing a processing zone comprises establishing a combustion zone, the step of introducing comprises introducing a processing gas containing oxygen, and the step of analyzing comprises analyzing the withdrawn gas sample for the concentration of oxygen in the withdrawn gas sample.

19. A method as claimed in claim 17 in which the processing zone is a combustion zone and the step of analyzing comprises analyzing the withdrawn gas sample for the concentration in the withdrawn gas sample of a constituent generated in the combustion zone.

20. A method as claimed in claim 17 in which the processing zone is a retorting zone and the step of analyzing comprises analyzing the withdrawn gas sample for the concentration in the withdrawn gas sample of a constituent generated in the retorting zone.

21. The method of claim 16 in which a sample of gas is withdrawn from the retort through a generally horizontal channel.

22. A method for determining the locus of at least one processing zone advancing through a fragmented permeable mass of formation particles containing oil shale in an in situ retort in a subterranean formation containing oil shale, the retort having a combustion processing zone advancing downwardly therethrough and a retorting processing zone advancing downwardly therethrough on the advancing side of the combustion zone, the retort being in direct fluid communication with at least one channel in unfragmented formation adjacent the retort and having gases passing therethrough, the method comprising the steps of:

withdrawing a first sample of gas from a first position in the retort through such a channel in fluid communication with the retort;

withdrawing a second sample of gas from a second position in the retort through such a channel in direct fluid communication with the retort, the first and second positions being at about the same elevation in the retort and laterally spaced apart from each other; and analyzing the composition of the withdrawn gas samples to determine the locus of a processing zone.

23. A subterranean formation at least partly prepared for in situ recovery of constituents from the formation comprising:

an in situ oil shale retort having boundaries of unfragmented formation and containing a fragmented permeable mass of formation particles and having a gas inlet and a gas outlet;

at least one channel in the unfragmented formation outside the boundaries of the in situ oil shale retort in direct fluid communication with the fragmented permeable mass at at least one location between the gas inlet and the gas outlet;

a well in the unfragmented formation outside the boundaries of the in situ retort and in fluid communication with the channel; and gas sampling means in the well.

24. The subterranean formation of claim 23 in which the channel is a naturally occurring permeable layer.

25. The subterranean formation of claim 24 in which the naturally occurring permeable layer is a tuff bed.

26. The subterranean formation of claim 23 in which the gas sampling means is a sample tube having an inlet to the interior of the tube.

27. The subterranean formation of claim 26 including straddle packers around the gas inlet to the sample tube.

28. The subterranean formation of claim 23 including straddle packers around the gas sampling means.

29. The subterranean formation of claim 23 comprising at least three wells in the unfragmented formation outside the boundaries of the in situ retort and in fluid communication with the fragmented mass.

30. The subterranean formation of claim 29 including gas sampling means in each well.

31. A method for sampling gas from an in situ oil shale retort in a subterranean formation containing oil shale, the retort having boundaries of unfragmented formation and containing a fragmented permeable mass of formation particles containing oil shale, the method comprising the steps of:

providing at least two wells through the subterranean formation outside the boundaries of the in situ oil shale retort in unfragmented formation;

establishing fluid communication between the wells and the permeable mass;

advancing a processing zone through the fragmented permeable mass;

withdrawing a sample of gas from the retort into each well; and analyzing composition of such a withdrawn gas sample to determine the locus of the processing zone.

32. The method of claim 31 in which the step of establishing fluid communication comprises providing a channel between the well and each fragmented mass by fracturing unfragmented formation between each well and the fragmented mass.

33. A method for sampling gas from an in situ oil shale retort in a subterranean formation containing oil shale, the retort having boundaries of unfragmented formation and containing a fragmented permeable mass of formation particles containing oil shale, the method comprising the steps of:

providing a well through the subterranean formation outside the boundaries of the in situ oil shale retort in unfragmented formation;

establishing fluid communication between the well and the fragmented mass by fracturing unfragmented formation between the well and the fragmented mass to form a channel between the well and the fragmented mass;

providing gas sampling means in the well adjacent the channel; and withdrawing a sample of gas from the retort into the well through the channel.

34. The method of claim 33 including the step of providing straddle packers around the gas sampling means.

35. A method for determining the locus of a processing zone advancing through a fragmented permeable mass of formation particles containing oil shale in an in situ oil shale retort in a subterranean formation containing oil shale, the retort having a processing zone advancing therethrough, the retort having boundaries of unfragmented formation, the method comprising the steps of:

drilling at least three holes through the subterranean formation outside the boundaries of the in situ oil shale retort in unfragmented formation;

establishing fluid communication between each such hole and the fragmented mass;

withdrawing a sample of gas from the fragmented mass into each such hole with a gas sampling means within each such hole; and analyzing the composition of each withdrawn gas sample to determine the locus of the processing zone.

36. The method of claim 35 in which the step of withdrawing a sample of gas into each hole comprises withdrawing a sample of gas from a first location in the retort to a first hole, withdrawing a sample of gas from a second location in the retort to a second hole, and withdrawing a sample of gas from a third location in the retort to a third hole, the locations being spaced apart from each other and in a plane substantially normal to the direction of advancement of the processing zone.

37. A subterranean formation at least partly prepared for in situ recovery of constituents from the formation comprising:

an in situ oil shale retort having boundaries of unfragmented formation and containing a fragmented permeable mass of formation particles;

at least one naturally occurring permeable layer in the unfragmented formation outside the boundaries of the in situ oil shale retort in direct fluid communication with the fragmented permeable mass;

a well in the unfragmented formation outside the boundaries of the in situ retort and in direct fluid communication with the permeable layer; and gas sampling means in the well.

38. The subterranean formation of claim 37 in which the naturally occurring permeable layer is a tuff bed.

39. The subterranean formation of claim 37 in which the gas sampling means is a sample tube having an inlet to the interior of the tube.

40. A method for sampling gas from an in situ oil shale retort in a subterranean formation containing oil shale, the retort having boundaries of unfragmented formation and containing a fragmented permeable mass of formation particles containing oil shale, the method comprising the steps of:

providing a well through the subterranean formation outside the boundaries of the in situ oil shale retort in unfragmented formation;

establishing fluid communication between the well and the fragmented mass by fracturing unfragmented formation between the well and the fragmented mass to form a channel between the well and the fragmented mass;

advancing a processing zone through the fragmented permeable mass;

withdrawing a sample of gas from the retort into the well through the channel; and analyzing composition of the withdrawn gas sample to determine the locus of the processing zone.

41. The method of claim 40 in which there is a processing zone advancing through the fragmented mass and the well extends through subterranean formation outside the boundaries of the in situ oil shale retort in a direction substantially parallel to the direction of advancement of the processing zone.

42. The method of claim 41 in which the step of withdrawing a sample of gas comprises withdrawing into such a well a sample of gas from a plurality of locations in the retort, the locations being spaced apart from each other in the direction of advancement of the processing zone through the fragmented mass.

* * * * *

UNITED STATES PATENT AND TRADEMARK OFFICE

CERTIFICATE OF CORRECTION

PATENT NO. : 4,151,877

DATED : May 1, 1979

INVENTOR(S) : Gordon B. French

It is certified that error appears in the above-identified patent and that said Letters Patent are hereby corrected as shown below:

Column 10, line 55, after "comprises" and before "withdrawn" insert -- analyzing --.

Signed and Sealed this

*Seventeenth* Day of *July 1979*

[SEAL]

*Attest:*

*Attesting Officer*

LUTRELLE F. PARKER

*Acting Commissioner of Patents and Trademarks*